United States Patent [19]

Newkirk

[11] 4,375,505

[45] Mar. 1, 1983

[54] FUSER MEMBER

[75] Inventor: James S. Newkirk, LeRoy, N.Y.

[73] Assignee: Eastman Kodak Company, Rochester, N.Y.

[21] Appl. No.: 313,871

[22] Filed: Oct. 22, 1981

[51] Int. Cl.[3] ..... B21B 31/08; B05D 1/02; B05D 1/34

[52] U.S. Cl. ..... 430/99; 427/194; 427/421; 427/425; 427/426; 118/60; 29/130; 29/132; 219/216; 427/409; 428/212; 428/422; 428/447; 428/448; 428/451

[58] Field of Search ..... 427/194, 425, 421, 426, 427/409; 118/60; 29/130, 132; 430/99; 219/216; 428/422, 212, 448, 447, 451

[56] References Cited

U.S. PATENT DOCUMENTS

| | | | |
|---|---|---|---|
| B 425,770 | 1/1975 | Thettu | 29/130 |
| T934010 | 5/1975 | Maskoenick | 29/130 |
| 2,852,415 | 9/1958 | Colbert et al. | 117/211 |
| 3,009,209 | 11/1961 | Weinbrenner et al. | 18/58 |
| 3,020,182 | 2/1962 | Daniels | 154/53 |
| 3,291,466 | 12/1966 | Aser et al. | 263/6 |
| 3,449,548 | 6/1969 | Adamek et al. | 219/216 |
| 3,452,181 | 6/1969 | Stryjewski | 219/216 |
| 3,776,760 | 12/1973 | Baker et al. | 29/132 |
| 3,849,062 | 11/1974 | Thettu et al. | 432/60 |
| 3,849,128 | 11/1974 | Ihara | 117/34 |
| 3,852,861 | 12/1974 | Baker et al. | 29/132 |
| 3,883,293 | 5/1975 | McCarroll | 432/60 |
| 3,912,901 | 10/1975 | Strella et al. | 219/216 |
| 3,948,214 | 4/1976 | Thettu | 118/60 |
| 3,967,042 | 6/1976 | Laskin et al. | 428/422 |
| 3,988,817 | 11/1976 | Thettu | 29/130 |
| 4,064,313 | 12/1977 | Takiguchi et al. | 427/22 |
| 4,092,953 | 6/1978 | Waugh | 118/642 |
| 4,098,631 | 7/1978 | Stryjewski | 156/221 |
| 4,199,626 | 4/1980 | Stryjewski | 427/444 |

FOREIGN PATENT DOCUMENTS

| | | | |
|---|---|---|---|
| 136080 | 7/1947 | Australia . | |
| 636311 | 2/1962 | Canada | 29/130 |
| 1456237 | 11/1976 | United Kingdom . | |
| 1456238 | 11/1976 | United Kingdom . | |
| 1456239 | 11/1976 | United Kingdom . | |

OTHER PUBLICATIONS

Product Licensing Index, Jul. 1972, Research Disclosures, Eelectrographic Fusing Apparatus, pp. 72 & 73.

Japanese Publication No. 41330/79, 9/5/73.

*Primary Examiner*—Shrive P. Beck

*Attorney, Agent, or Firm*—William F. Noval

[57] ABSTRACT

A fuser member has a composite layer including (1) a first layer of a first material which is an elastomer; (2) a second layer of a second material comprising elastomeric fluoropolymer which is a crosslinked polymer having repeating units of tetrafluoroethylene and perfluoroalkyl perfluorovinylether; and (3) a layer intermediate to and continuous with the first and second layers in which the proportion of the first material to the second material gradually varies from substantially only the first material to substantially only the second material.

Methods of making the fuser member by a spray technique and of using the fuser member to fuse toner images to a receiver are also disclosed.

26 Claims, 6 Drawing Figures

FUSER MEMBER

CROSS-REFERENCE TO RELATED APPLICATION

Reference is made to commonly-assigned U.S. patent application Ser. No. 313,914 filed on Oct. 22, 1981 for Fuser Member in the names of James S. Newkirk and Robert A. Wiederhold.

BACKGROUND OF THE INVENTION

This invention relates generally to the field of electrography and more particularly, this invention relates to the fusing of toner images to receivers by means of heat and pressure.

In the field of electrography, as practiced, for example, in commercial copiers, a radiation image of an original to be reproduced is projected upon a uniformly charged photoconductive member to produce a latent electrostatic image corresponding to the original image. A visible toner image is produced by developing the electrostatic image with charged toner particles. If the photoconductive member is reusable in the form of a belt or drum, the toner image is then transferred to a receiver such as a web or sheet of plain paper and fused to the receiver. If the photoconductive member itself is the receiver, then the toner image is fused directly to the member.

One technique which may be used to fuse a toner image to a receiver is through the application of heat and pressure by contacting the toner image with a heated fuser member such as a roller or belt. Commonly, a pair of rollers held together under pressure form a nip through which a toner image carrying receiver is passed. One or both of the rollers are heated to melt the heat softenable toner particles to fuse the toner image to the receiver.

In such fusers, one or both rollers preferably include an elastomeric layer to lengthen the nip through which the toner image passes in order to increase fusing time and to lower fusing energy requirements. The elastomeric layer should be resistant to degradation at high temperatures over a long operating life. In addition, the surface of the fuser roller contacting the toner image should be of a material having good release characteristics to prevent offset of toner particles onto the surface of the fuser roller and to obviate the tendency of the copy sheet to wrap around one of the rollers causing copier malfunction. Although silicone elastomers and fluoroelastomers exhibit good resistance to degradation at high temperatures as well as good release characteristics, it has been found necessary to apply a coating of fuser oil to the fuser roller in order to eliminate any possibility of offset to the roller of contaminants such as toner, paper particles, etc. Thus, various fuser oils such as fluorocarbon oils, silicone oils, and fluorosilicone oils may be applied to the fuser roller to improve its toner offset preventing characteristics.

Additionally, in commercial electrographic copiers which process several thousand copy sheets per hour, it is highly desirable that the fuser be capable of operating over a long life so that the operation of the machine is not interrupted by fuser paper jams or replacement of a defective fuser component. Fusers including a silicone elastomer roller to which silicone fuser oil is applied in combination with a fluoropolymer-coated metallic pressure roller have succeeded in minimizing paper jams caused by toner offset and in increasing the operating life of the fuser. Over a period of time, however, the silicone fuser oil tends to be absorbed into the silicone elastomer causing it to swell. This swell may cause the growth of a step pattern in the roller if copy sheets of a variety of lengths are processed by the copier. These steps are formed by greater swelling due to fuser oil absorption beyond the areas of the roller used to process the shorter length copies. When longer length copies are passed through the nip of the roller fuser, uneven fusing causes image deterioration in the processed copy sheet. Since image deterioration is undesirable, the roller fuser member may have to be replaced necessitating a service call and incapacitating the copier for several hours with attendant inconvenience, frustration and cost. Step growth pattern in elastomeric fuser rollers has been found to be especially persistent when both fuser roller members are provided with elastomeric layers as when processing copy sheets with unfused toner images on both sides of the sheet.

Swelling of a silicone elastomeric layer by absorption of fuser oil may be minimized by providing a multi-layer fuser member wherein the silicone elastomeric layer is overcoated with a layer of material which is resistent to absorption of silicone fuser oil. Such silicone oil resistant materials include the fluoroelastomers such as fluorosilicone elastomer and fluoropolymer-based elastomers such as various vinylidene fluoride-based elastomers which contain hexafluoropropylene as a comonomer, for example, Viton® A (vinylidene fluoride-hexafluoropropylene) and Viton® B (vinylidene fluoride-hexafluoropropylene-tetrafluoroethylene) which are available from the Dupont Company. Viton® is a trademark of DuPont. Such materials are substantially more resistent to silicone fuser oil absorption than silicone elastomer and substantially decrease the forming of steps in the silicone elastomeric underlayer. In order to increase the release characteristics of the fuser roller, a thin coating of silicone elastomer may be applied to the fluoroelastomer to form a three-layered fuser member.

Although the aforementioned multilayer fuser rollers have been found to minimize the formation of steps and consequent image degradation in processed copy sheets, thereby substantially increasing the life of the fuser roller, it has been found difficult to form the multilayered fuser members due to the difficulty in adhering fluoroelastomers to silicone elastomers. Thus, a fuser roller having a silicone elastomer base layer to which is adhered a fluoroelastomer layer has been found to exhibit separation between the layers with prolonged use. This separation may be accounted for by the lack of affinity of the fluoroelastomers for other materials and by the constant flexing of the fuser roller during use.

As a consequence of the foregoing problems associated with known fuser members, the need has been present for a fuser member to which fuser oil may be applied without swelling of the member and resultant step formation therein. The member should have a long operating life and be able to function at high fusing temperatures without structural failure. A multilayered fuser roller should not have interlayer separation over its useful life.

SUMMARY OF THE INVENTION

In accordance with the present invention, there is provided an improved fuser member and method of making and using such member which is resistent to the formation of steps in the surface of the member caused by the absorption of fuser oil applied to it. The fuser member is provided with a long life capable of processing several hundred thousand copy sheets without a noticeable deterioration in the image quality of fused images and without damage to the sheets.

According to one aspect of the invention, a method of forming a member for fusing toner images to a receiver is provided in which a base member is sprayed with a first material which is an elastomer. After a layer of the first material is formed, the first material is continued to be sprayed while spraying a gradually increasing proportion of a second material with the first material until only the second material is sprayed. Spraying of the second material is thereafter continued to form a layer of only the second material. Preferably the first material is a high-temperature resistant elastomer. The second material is resistant to degradation at high temperatures and is impervious to absorption of fuser oil by the first material and comprises an elastomeric fluoropolymer which is a crosslinked polymer having tetrafluoroethylene repeating units and perfluoroalkyl perfluorovinylether repeating units.

According to another aspect of the invention, a fuser member is provided which has a composite layer including (1) a first layer of a first material which is an elastomer; (2) a second layer of a second material comprising an elastomeric fluoropolymer which is a crosslinked polymer having tetrafluoroethylene repeating units and perfluoroalkyl perfluorovinylether repeating units; and (3) a layer intermediate to and continuous with the first and second layers in which the proportion of the first material to the second material gradually varies from substantially only the first material to substantially only the second material. Preferably the first material is a high-temperature resistant elastomer. The second elastomeric fluoropolymer material is resistant to degradation at high temperatures and is impervious to absorption of fuser oil by the first material. According to another aspect of the invention the fuser member comprises a fuser roller having a composite layer as described above.

Another aspect of the invention provides a method for fusing toner images to a receiver by contacting a toner image with a fuser member having a composite layer as described above.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanied drawings in which.

DESCRIPTION OF THE PREFERRED EMBODIMENTS

Figure 1:
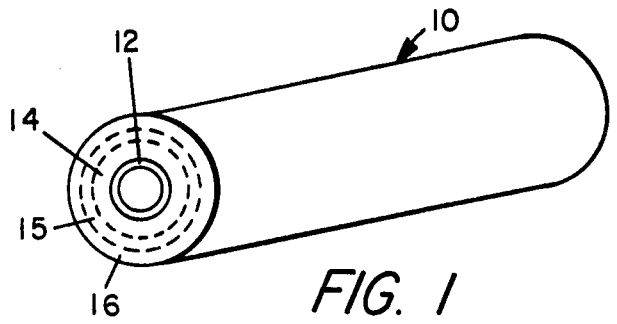
FIG. 1 is one embodiment of a fuser roller member according to the present invention.

According to the present invention, multi-layer fuser members of different configurations may be provided. For example, the fuser member may comprise a flat plate. However, in commercial electrophotographic copiers, the most common configuration of fuser member is a roller. Accordingly, the embodiment shown in FIG. 1 includes a fuser roller 10 which may be heated internally. Roller 10 includes a core 12 of heat conductive material such as aluminum, brass or stainless steel or heat transmissive material such as glass. A composite layer bonded to core 12 includes layers 14 and 16 of elastomeric materials which are resistant to degradation at high temperatures in the range of 100° C. to 200° C. According to one embodiment of the present invention, the material of layer 14 is a polysiloxane elastomer such as silicone elastomer. The material of layer 16 is an elastomeric fluoropolymer which resists absorption of fuser oil absorbed by the first layer material and which comprises a crosslinked polymer having tetrafluoroethylene repeating units and perfluoroalkyl perfluorovinylether repeating units.

According to the present invention, a layer 15 is intermediate to and continuous with layers 14 and 16 and comprises a gradually varying mixture from only the material of layer 14 to only the material of layer 16. Layer 14 may be previously formed on core 12 by known techniques such as molding, before application of layer 16 or layer 14 may be formed during the process in which layer 16 is formed. Where a thickness of layer 14 has already been formed on core 12, preferably a thin coating of the same elastomer as layer 14 is initially sprayed onto layer 14 to form a continuous layer therewith. While the material of layer 14 is continued to be sprayed, the material which is to form layer 16 is simultaneously sprayed in gradually varying proportion with the layer 14 material. As spraying continues, the proportion of the layer 14 material decreases while the proportion of layer 16 material increases until only the layer 16 material is being sprayed. Only this material is then sprayed to the desired thickness of layer 16. Alternatively, the layer 14 material may be sprayed directly upon core 12 and a desirable thickness thereof built up before the formation of layer 15 is initiated.

The gradually varying layer 15 formed between layers 14 and 16 may be effected in several ways. In one method, the proportion of the layer 14 material and the layer 16 material being sprayed is continuously changed so that initially only layer 14 elastomer is sprayed and finally only layer 16 elastomer is being sprayed with the proportion of the two materials continuously varying during the spraying process. In another method, the proportions are changed in fixed steps so that, for example, initially only layer 14 elastomer is sprayed; then say, a mixture of 75% of layer 14 elastomer and 25% of layer 16 elastomer is sprayed; then a mixture of 50% of each elastomer is sprayed; then a mixture of 25% of layer 14 elastomer and 75% of layer 16 elastomer is sprayed; and then only layer 16 elastomer is sprayed. Other variations in the proportions of materials and number of layers may be effected within the scope of the present invention.

The layer 14 elastomer and layer 16 elastomer are preferably dissolved in the same solvent or solvents or in solvents in which both elastomers are soluble prior to spraying in order to maximize compatibility of the materials once sprayed on the roller. The solvents used are preferably as suitable mixture of low boiling point and high boiling point solvents, the ratio of one solvent to another being selected to obtain proper drying time to insure acceptable roller properties such as the ability to resist delamination between layers.

The fluorinated polymeric materials useful as the second material are crosslinked fluoropolymers having tetrafluoroethylene repeating units and perfluoroalkyl perfluorovinylether repeating units. The perfluoroalkyl perfluorovinylether monomers used in the preparation of such fluorocarbon materials have the structural formula noted hereinbelow:

$$ROCF{=}CF_2 \qquad \text{I}$$

wherein R is a perfluoroalkyl group containing 1 to about 5 carbons, preferably 1 to about 3 carbon atoms. A particularly useful perfluoroalkyl perfluorovinylether monomer useful in preparing the above-described fluorocarbon elastomers is a perfluoromethyl perfluorovinylether monomer, i.e., a material having the formula I wherein R is a perfluoromethyl group. Copolymers having the above-described tetrafluoroethylene repeating units and perfluoroalkyl perfluorovinylether repeating units have previously been described in the fluorocarbon polymer art and detailed information concerning the preparation of these materials may be found, for example, in U.S. Pat. No. 3,132,123, issued May 5, 1964; Canadian Pat. No. 894,898, issued Mar. 7, 1972; in the article entitled "A High-Performance Fluorocarbon Elastomer" authored by A. L. Barney et al and appearing in the Journal of Polymer Science; Part A-1, Vol. 8 pp. 1091–1098 (1970) and in commonly assigned U.S. Pat. No. 4,199,626, issued Apr. 22, 1980.

It is believed that those copolymers of the type noted immediately hereinabove which provide best results are copolymers having tetrafluoroethylene units and perfluoroalkyl perfluorovinylether units wherein the amount of the ether monomer in the polymer chain is greater than about 30 mole percent and preferably on the order of from about 30 to 50 mole percent of the polymer chain. Fluorocarbon polymers containing repeating tetrafluoroethylene units and repeating perfluoroalkyl perfluorovinylether units which have less than about 30 mole percent of the ether monomer in the polymer chain can also be used although such monomers are believed to exhibit somewhat lower temperature stability and somewhat less chemical resistance properties.

As noted hereinabove, the copolymers useful as the second material are crosslinked (i.e., vulcanized) copolymers. Such crosslinked copolymers may be prepared by at least several different techniques.

One such technique for preparing crosslinked copolymers is described in U.S. Pat. No. 3,686,154, issued Aug. 22, 1972 and relates to the use of a curing agent selected from the group consisting of polyfunctional tertiary amines and precursors thereof capable of forming such amines in situ. Such curing agents can be admixed with the aforementioned copolymer having repeating tetrafluoroethylene units and repeating perfluoroalkyl perfluorovinylether units; and, in the presence of heating, one obtains the desired crosslinked fluorocarbon elastomer as the endothermic reaction product of the above-described copolymer and crosslinking agent. The amount of crosslinking agent used in the preparation of the aforementioned endothermic reaction product typically is within the range of from about 2 to about 5 percent of crosslinking agent based on the weight of the aforementioned copolymer.

Typical useful such crosslinking agents, as noted above, are polyfunctional tertiary amines or precursors thereof capable of forming such amines in situ. A partial list of useful such materials is set forth in U.S. Pat. No. 3,686,154 and includes salts of triethylenediamine (e.g., the sulfates, chlorides and borates) which are capable of forming the tertiary amines in situ during heating; tris(-dodecylmethylene)diamine; 3-(1,5-diazobicyclo)(3,2,1)-oct-8-yl indole; 4,4'-methylene-bis(N,N'-dimethyl aniline); 2,3-bis-(2-pyridyl)-5,6-dihydropyrazine; 4,4'-trimethylene dipyridine; 4,4'-trimethylene-bis-(N-piperidine ethanol); N,N'-bis-(R)piperazines wherein R is a $C_1$–$C_6$ alkyl group of a substituted analog thereof (e.g., containing an amino, halide, or hydroxy substituent); and Troegers base, which is also known as 2,8-dimethyl 6H, 12H-5, 11-methanodibenzo[b,f][1,5]diazocine. Especially preferred as useful polyfunctional tertiary amine compounds are triethylenediamine and N,N'-bis-(3-aminopropyl)piperazine.

Another useful method for preparing the crosslinked fluorocarbon copolymers useful as the second material is to blend a third fluorinated monomer together with the tetrafluoroethylene and perfluoroalkyl perfluorovinylether monomers used in making the initial copolymer such that one obtains a terpolymer of tetrafluoroethylene, perfluoroalkyl perfluorovinylether and the third fluorinated monomer. The latter component, i.e., the fluorinated monomer, is a monomer containing fluoroalkyl or fluoroalkylene groups and a crosslinking site such that the resultant terpolymer containing the same may be readily crosslinked in the presence of suitable curing agents such as hydrazine or aliphatic diamines containing 2 to 20 carbon atoms, e.g., p-phenylene diamine, tetraethylene pentamine, hexamethylene diamine carbonate, etc. The third component fluorinated monomers containing a crosslinking site may be selected from various such monomers. For example, this monomer may be selected from a class of monomers containing a perfluoroalkyl or perfluoroalkylene group and a crosslinking site, such as monomers having one of the following structural formulas: Either

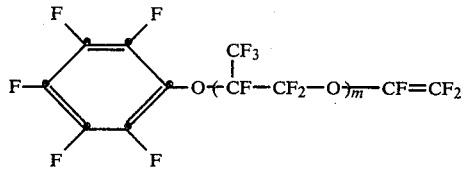

II wherein m represents the integer of 1 or 2. or $$CF_2{=}CF{-}O{-}(CF_2)_n{-}X \qquad \text{III}$$

wherein n is an integer of from about 2 to about 12, preferably 2–4, —X is a member selected from the group consisting of —COF, —COOH, —$COOR_1$, —COOM, —$CONR_2R_3$ and —CN, $R_1$ being an alkyl radical containing 1 to 10 carbon atoms, $R_2$ and $R_3$ each being hydrogen or $R_1$, and M being sodium, potassium or cesium.

Terpolymers containing the above-described tetrafluoroethylene units, perfluoroalkyl perfluorovinylether units, and fluorinated monomers bearing a crosslinking site are known in the art and have been described, for example, in U.S. Pat. No. 3,467,638 dated Sept. 16, 1969 and in the article entitled "Vulcanizate Properties from a New Perfluoroelastomer" by A. L. Barney et al in Rubber Chemistry and Technology, Vol. 44, No. 3, June 1971, pp. 660–667. In general, these terpolymers, prior to crosslinking with a curing agent(s), contain only a minor amount of the fluorinated monomer bearing a crosslinking site; for example, a typical terpolymer contains from about 0.1 to about 5 percent by weight of repeating units derived from the monomer bearing a crosslinking site. Further details regarding the crosslinked copolymer, including crosslinked terpolymers, useful as the second material may be found in the aforementioned patent publications and journal articles incorporated herein by reference thereto.

Figure 2:
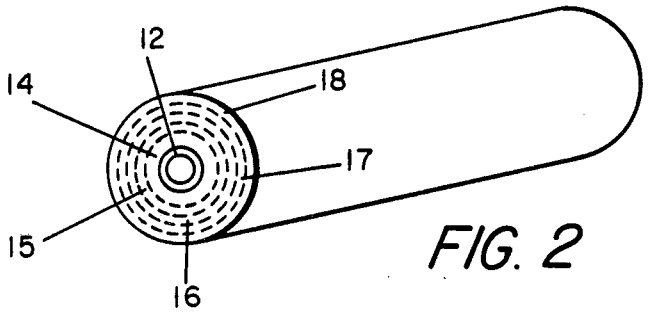
FIG. 2 is another embodiment of a fuser roller member according to the present invention.

In the embodiment of FIG. 2, a third layer 18 of toner offset preventing elastomer is provided which contacts a toner image carried by a receiver. A layer 17 is intermediate to and continuous with layers 16 and 18 and comprises a gradually varying proportion of the layer 16 elastomer and the layer 18 elastomer from substantially only the layer 16 elastomer to substantially only the layer 18 elastomer. The elastomer of layer 18 is preferably the same as the elastomer of layer 14 and may, for example, comprise silicone elastomer. Layer 16 is a fuser oil resistant fluoroelastomer comprising a crosslinked polymer having tetrafluoroethylene repeating units and perfluoroalkyl perfluorovinylether repeating units and substantially prevents any oil which may be absorbed by layer 18 from penetrating to layer 14 and thereby swelling it.

Figure 3:
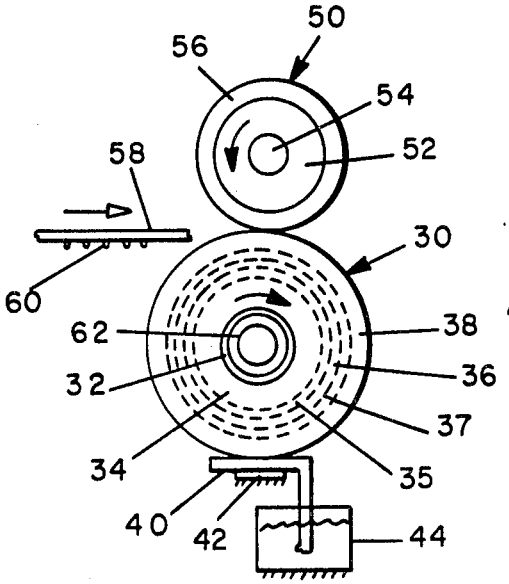
FIG. 3 shows the fuser member of FIG. 2 as used in a roller fuser for fixing simplex images.

Referring now to FIG. 3, there is shown a fuser roller according to the embodiment of FIG. 2 incorporated into a roller fuser used in an electrographic copier for fusing simplex receivers, i.e., receivers carrying toner images on one side thereof. As shown, roller 30 includes a metallic core 32; a first layer 34 of high-temperature resistant silicone elastomer bonded thereto; a second layer 36 of fluoroelastomer which is impervious to fuser oil and resistant to degradation at high temperatures which comprises a crosslinked polymer having tetrafluoroethylene repeating units and perfluoroalkyl perfluorovinylether repeating units; and a layer 35 intermediate to and continuous with layers 34 and 36 in which the proportion of the silicone elastomer to the fluoroelastomer gradually varies from substantially only the silicone elastomer to substantially only the fluoroelastomer. A third layer 38 is provided which may be any high temperature resistant material which has good toner offset preventing characteristics. Preferably layer 38 is of the same material as layer 34 and therefore may comprise silicone elastomer. However, this material may be any other high temperature resistant elastomer which shows good toner offset preventing characteristics or may be a flexible polymer which is not elastomeric but which has good toner offset preventing characteristics and which is heat resistant, such as the fluoropolymer which comprises a copolymer of tetrafluoroethylene and polypropylene.

Layer 37 is intermediate to and continuous with layers 36 and 38 in which the proportion of the layer 36 material to the layer 38 material gradually varies from substantially only the layer 36 material to substantially only the layer 38 material.

In order to enhance the toner offset preventing characteristics of the surface of layer 38, fuser oil is applied by means of a wick 40 held against roller 30 by member 42. Wick 40 is saturated with fuser oil contained in sump 44. A large number of known fuser oils are commercially available and suitable for such use. For example, a series of silicone glycol copolymer liquids as well as an alkylaryl silicone liquid, a chlorophenylmethyl silicone liquid, a dimethyl silicone liquid and a fluorosilicone liquid are commercially available from Dow Corning Company. Additional useful materials would include polyvinylidene fluoride liquids, polymonochlorotrifluoroethylene liquids, hexafluoropropylene vinylidene fluoride copolymers, perfluoroalkyl polyethers (available under such names as Fomblyn, Krytox, sold by Montecatini-Edison and DuPont, respectively), fluoroalkyl esters, block copolymers of dimethyl siloxane with a variety of materials such as Bisphenol A, tetramethylspirobi(indan)diol and the like. Of course, other fuser agents exhibiting good thermal stability are also useful. Obviously, in selecting an offset-preventing liquid, care should be taken to select a liquid which is chemically compatible with the toner offset preventing layer on which it is applied.

A pressure roller 50 is held in pressure engagement with fuser roller 30 by suitable force-applying means such as that disclosed in Research Disclosure No. 13,703, September 1975, published by Industrial Opportunities, Ltd., Homewell, Havant, Hampshire, UK. Pressure roller 50 includes a core 52 of metallic material mounted on shaft 54 and an outer layer 56 of material having good toner offset preventing characteristics such as polytetrafluoroethylene, silicone elastomer or fluoroelastomers such as the vinylidene-fluoride based fluoropolymeric elastomers. Rollers 50 and 30 form a nip through which is passed receiver 58 carrying an unfixed toner image 60 on its underside. Through heat and pressure, toner image 60 is fixed permanently to receiver 58 as it passes through this nip. Due to the toner offset preventing properties of layers 56 and 38, any fuser oil applied to layer 38 by wick 40, rollers 30 and 50 will not be contaminated by toner from receiver 58 and receiver 58 will exit the roller nip without sticking to either of these rollers. Thus, jams and fuser malfunction are obviated.

The lineal pressure between rollers 30 and 50 may vary, but typically is within the range from about 0.05 to about 4 kilograms per centimeter of roller length. The temperature maintained in the nip which serves as the heat fixing zone of the roller fuser is generally within the range of from about 110° to about 260° C. The temperature chosen is a function of the softening temperature of the toner powder, the rate at which the receiver material carrying the toner powder image is passed through the nip of the fuser roller, the length of the nip, and the force of roller engagement.

To further enhance the various properties of fuser roller 30, it may be useful in certain situations to provide various fillers to further enhance thermal properties, mechanical strength, or toner offset preventing properties of the outer layer of the fuser member. Typically, the thick elastomeric layer 32 will contain various fillers such as carbon black or silica for strength and various metal oxides, metal particles, or the like to enhance the thermal conductivity of the elastomeric material. In addition, various plasticizers or the like may be used where necessary or where desirable.

Although fuser roller 30 of FIG. 3 is shown as including an internal heating source such as quartz lamp 62, other internal heating sources may be provided such as a heated liquid or a resistance element located within the roller core. In the alternative, an external source of thermal energy may be provided to heat the surface of fuser roller 30.

Figure 4:
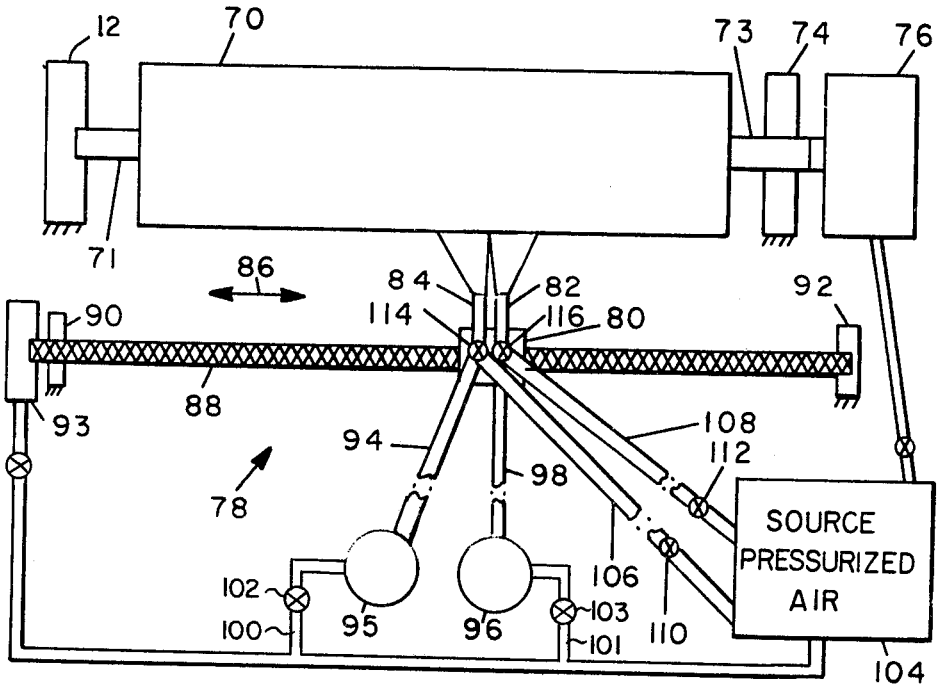
FIG. 4 is an apparatus which may be used in effecting the method of the present invention.

Referring now to FIG. 4, there is shown apparatus which is useful for carrying out the method of the present invention in forming fuser rollers. As shown, a fuser roller 70 to be sprayed according to the method of the present invention is rotatably mounted in bearings 72 and 74 by gudgeons 71 and 73, respectively. A motor 76 is connected to roller 70 to rotate it at a predetermined rotational speed. Spray assembly 78 is provided and includes a carriage 80 upon which are mounted spray heads 82 and 84. Carriage 80 is driven for movement in directions 86 by means of screw thread 88 rotatably mounted in bearings 90 and 92 and driven by motor 93. The spray area of spray heads 82 and 84 are contiguous. Spray head 84 is supplied with first material to be sprayed from reservoir 95 by means of flexible conduit 94. In like manner, spray head 82 is supplied with second material to be sprayed from reservoir 96 by means of flexible conduit 98. A source 104 of pressurized fluid such as air provides pressure to drive fluid motors 76 and 93 and also to provide a pneumatic source for spraying materials from spray heads 84 and 82 and to provide pressure to reservoirs 95 and 96. Conduits 100 and 101 having regulators 102 and 103 supply pressurized air to reservoirs 95 and 96, respectively. Conduits 106 and 108 provide pressurized air to spray heads 84 and 82 respectively. Valves 110 and 112 control the amount of air supplied over conduits 106 and 108 respectively, while valves 114 and 116 control the actuation of spray heads 84 and 82.

Following is a description of the formation of a fuser roller 70 according to the method of the present invention using the apparatus of FIG. 4. The spraying operation may be carried out at ambient temperature and humidity but both temperature and humidity are preferably controlled for best results to avoid extremes of either or both. Fuser roller 70 will be assumed to have a final structure in accordance with the multi-layer roller shown in FIG. 2. In such case, the fuser roller may comprise first and third layers of silicone elastomer and a second layer of a fluoroelastomer comprising a crosslinked fluoropolymer having tetrafluoroethylene repeating units and perfluoroalkyl perfluorovinylether repeating units. The latter material is highly impervious to fuser oil which is absorbed by silicone elastomer and is resistant to degradation while operating at high temperatures in the range of 100°–200° C. Silicone elastomer is also highly resistent to deterioration at high operating temperatures but exhibits a greater tendency to absorb fuser oils thus causing undesirable swelling and formation of steplike patterns over prolonged use. Thus, the first layer is formed of silicone elastomer and provides the thickest layer of the multilayer fuser roller. The third layer in contact with a receiver carrying a toner image is preferably also of silicone elastomer. The second layer of fluoroelastomer provides a barrier layer to prevent absorption of fuser oil by the first elastomer layer.

Reservoirs 95 and 96 should contain sufficient quantities of silicone elastomer and fluoroelastomer so that fuser roller 70 may be formed without replenishment of reservoirs 95 and 96 during the spraying process. Where several fuser rollers are to be made in succession, the capacity of reservoirs 95 and 96 should be great enough so that they need be replenished less frequently in order to maintain productivity.

An exemplary fuser roller 30 may, for example, include a core 32 of aluminum having an outside diameter of three inches. A first layer of silicone elastomer of forty to eighty thousandths of an inch thickness is initially applied to the core. A second layer of fluoroelastomer material which is resistant to fuser oil absorbed by the first layer elastomer approximately ten thousandths of an inch thick is subsequently sprayed on the silicone elastomer layer according to the method of the present invention. A third layer of ten to twenty thousandths of an inch of silicone elastomer is then applied to the fluoroelastomer layer by means of the method of the present invention.

A fuser roller is formed by the apparatus of FIG. 4 as follows:

An aluminum cylinder 70 which may be pretreated to promote adhesion of the first layer elastomer is rotatably mounted in bearings 72 and 74 by means of gudgeons 71 and 73. Motor 76 is connected to gudgeon 73 and causes cylinder 70 to rotate at a predetermined velocity. Simultaneously, motor 93 causes spray heads 84 and 82 carried by carriage 80 to move back and forth across cylinder 70 as it is rotated by motor 76. The rotational velocity of roller 70 and velocity of carriage 80 are synchronized to effect the desired buildup of layers on roller 70. Layer buildup is also a function of the rate of spraying by spray heads 84 and 82 and of the characteristics of materials being sprayed.

As roller core 70 is rotated and carriage 80 is caused to move back and forth across the width of roller 70, silicone elastomer is sprayed upon core 70 to build up the first layer to the desired thickness of e.g., forty thousandths of an inch. Since spraying techniques might require an unnecessarily long time for building up such a thickness, it may be desirable to provide a core 70 upon which a layer of silicone elastomer has already been formed by other techniques such as molding. Then, only an initial thin layer of silicone elastomer need be applied over this layer so that the time required for spraying is substantially reduced. Alternatively, a mixture of silicone elastomer and fluoroelastomer may be sprayed immediately on the silicone layer.

After the desired thickness of silicone elastomer has been sprayed onto core 70, silicone elastomer is continued to be sprayed upon roller 70, valve 116 is gradually opened to actuate spray head 82. Valve 114 which has been fully opened during spraying of silicone elastomer only by head 84 is now gradually closed while valve 116 is gradually opened so that the mixture of the silicone elastomer and fluoroelastomer sprayed by heads 84 and 82 will gradually vary from only silicone elastomer being sprayed to only fluoroelastomer being sprayed. When only fluoroelastomer is being sprayed, valve 114 will have been closed, valve 116 will be fully opened, and fluoroelastomer will continue to be sprayed until the desired thickness of the fluoroelastomer layer is built up.

To build up an outer layer of silicone elastomer, the reverse process is now effected. As fluoroelastomer is continued to be sprayed upon roller 70 silicone elastomer is progressively added to the spray mixture until only silicone elastomer is being sprayed to a desired thickness. The multilayer fuser roller is then removed from the spraying apparatus and cured by known curing techniques such as by heat.

Figure 5:
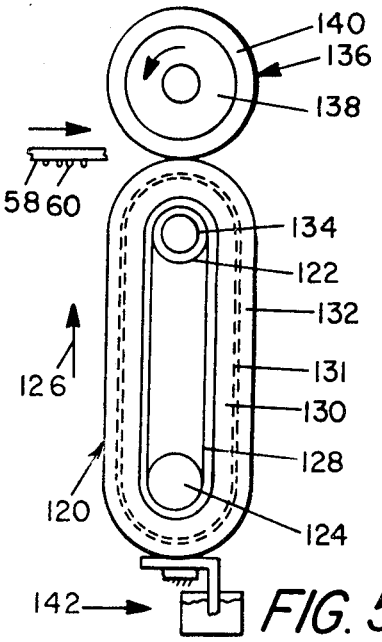
FIG. 5 is another embodiment of the fuser member of the present invention.

Referring now to FIG. 5, there is shown another embodiment of the present invention. As shown, a belt 120 is disposed about rollers 122 and 124 for movement in the direction of arrow 126. Belt 120 comprises a support layer 128 of heat conductive material such as metal. Upon layer 128 is bonded heat conductive elastomeric layer 130 of suitable material such as silicone rubber. Also provided are outer layer 132 of fuser oil-impervious fluoroelastomer comprising crosslinked fluoropolymers having tetrafluoroethylene repeating units and perfluoroalkyl perfluorovinylether repeating units and layer 131 intermediate to and continuous with layers 130 and 132 in which the proportion of the silicone elastomer to the fuser-oil impervious elastomer gradually varies from substantially only silicone elastomer to substantially only oil-impervious elastomer. Positioned within roller 122 is a source of heat such as quartz tube 134. A pressure roller 136 has a core 138 and an outer layer 140 of toner offset preventing material such as polytetrafluoroethylene. A wicking assembly 142 applies fuser oil to the outer surface of layer 132 to prevent offsetting of toner particles from processed receivers onto belt 120. In operation, a receiver 58 carrying a toner image 60 on its lower side is moved through the nip between pressure roller 36 and heated fuser belt 120 to permanently fix image 60 to receiver 58.

Figure 6:
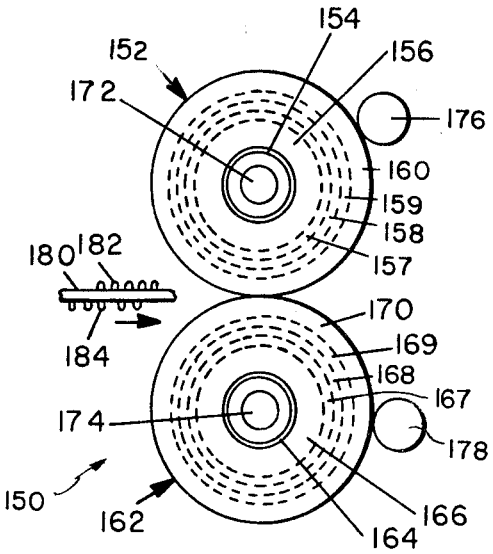
FIG. 6 is a fuser roller incorporating two fuser members according to the embodiment of FIG. 2 in fixing duplex images to a receiver.

Referring now to FIG. 6, there is shown another embodiment of the present invention wherein duplex images on a copy sheet are fixed by a pair of fuser rollers made according to the present invention. As shown, a roller fuser 150 includes a pair of identical rollers made according to the embodiment of FIG. 2. Upper fuser roller 152 includes a heat conductive core 154 upon which is bonded a first layer 156 of silicone elastomer of desired thickness, a second layer 158 of a fluoroelastomer impervious to fuser oil absorbed by the layer 156 elastomer comprising crosslinked fluoropolymers having tetrafluoroethylene repeating units and perfluoroalkyl perfluorovinylether repeating units and a third outer layer 160 of silicone elastomer. Gradually varying layers 157 and 159 according to the present invention are respectively intermediate to and continuous with layers 156, 158 and layers 158, 160. Lower roller 162 is identical to roller 152 and includes heat conductive core 164, first layer 168 of fuser oil-impervious fluoroelastomer the same as the fluoroelastomer of layer 158 and third layer 170 of silicone elastomer. Gradually varying layers 167 and 169 according to the present invention are respectively intermediate to and continuous with layers 166, 168 and 168, 170.

Disposed within rollers 152 and 162 are heat sources such as quartz tubes 172 and 174 respectively. Fuser oil such as dimethyl silicone oil may be applied to the surfaces of rollers 152 and 162 by applicator rollers 176 and 178 respectively.

A copy sheet 180 having unfixed images 182 and 184 on opposite sides thereof is passed through the nip formed by rollers 152 and 162 which are held in pressure engagement. The temperature and pressure of fixing the toner images is a function, among others, of the characteristics of the toner material and the amount of time that the toner images are in the nip formed by rollers 152, 162.

The invention has been described in detail with particular reference to the preferred embodiment thereof, but it will be understood that variations and modifications can be effected within the spirit and scope of the invention.

What is claimed is:

1. The method of forming a member for fusing toner images to a receiver, comprising:

spraying a base member with a first material which is an elastomer;

after a layer of the first material has been formed continuing to spray said first material while spraying a gradually varying proportion of a second material with said first material until only said second material is sprayed; and continuing to spray said second material only to form a layer of said second material:

wherein said second material is an elastomeric fluoropolymer being a crosslinked polymer comprising repeating units of tetrafluoroethylene and perfluoroalkyl perfluorovinylether.

2. The method of claim 1 including continuing to spray said second material while simultaneously spraying a gradually varying proportion of a third material which prevents offset of toner thereto; and continuing to spray only said third material to form a layer thereof which contacts a toner image to be fused to a receiver.

3. The method of claim 1 wherein said first material is a high-temperature resistant elastomer.

4. The method of claims 1, 2, or 3 wherein said first material is a silicone elastomer.

5. The method of claim 2 wherein said first and third materials comprise silicone elastomer.

6. The method of claims 1 or 2 wherein said member comprises a roller and includes rotating said roller while spraying said materials thereon.

7. The method of claim 1 wherein said second material is sprayed in a gradually increasing proportion of said second material to said first material until only said second material is sprayed.

8. The method of claims 1, 2, 3, or 5 including curing said member after completion of said spraying of said materials.

9. The method of claims 1, 2, 3, or 5 wherein prior to spraying said first and second elastomer materials are respectively dissolved in the same solvent or in solvents in which both elastomers are soluble.

10. A member for fusing toner images to a receiver comprising:

a composite layer including:

(1) a first layer of a first material which is an elastomer;

(2) a second layer of a second material which is an elastomeric fluoropolymer having a crosslinked polymer comprising repeating units of tetrafluoroethylene and perfluoroalkyl perfluorovinylether; and (3) a layer intermediate to and continuous with said first and second layers in which the proportion of the first material to the second material gradually varies from substantially only the first material to substantially only the second material.

11. The member of claim 10 wherein said first material is a high-temperature resistant elastomer.

12. The member of claims 10 or 11 wherein said first material is a silicone elastomer.

13. The member of claim 10 wherein said composite layer includes a third layer of a third material which prevents offset of toner thereto and a layer intermediate to and continuous with said second and third layers in which the proportion of the second material to the third material gradually varies from substantially only the second material to substantially only the third material.

14. The member of claim 13 wherein said toner offset preventing material is a silicone elastomer.

15. The member of claim 10 wherein the thickness of said first layer is substantially greater than the thickness of said second layer.

16. The member of claim 10 wherein the proportion of the first material to the second material in said intermediate layer gradually increases from substantially none of said second material to substantially all of said second material.

17. The member of claims 10, 11, 13, 14, or 15 wherein said member has been cured.

18. A fuser roller for fusing toner images to a receiver comprising:

a cylindrical core;

a composite layer on said core including:

(1) a first layer of a first material which is an elastomer;

(2) a second layer of a second material which is resistant to absorption of fuser oil and which is an elastomeric fluoropolymer having a crosslinked polymer comprising repeating units of tetrafluoroethylene and perfluoroalkyl perfluorovinylether; and (3) a layer intermediate to and continuous with said first and second layers in which the proportion of the first material to the second material gradually varies from substantially only the first material to substantially only the second material.

19. The roller of claim 18 including a second roller forming a nip with said first roller through which is passed a receiver carrying at least one toner image to be fused by said rollers.

20. The roller of claim 18 wherein said core comprises a cylindrical shell of heat conductive or heat transmissive material and including a source of heat located with said shell.

21. The roller of claim 18 wherein said first material is a high-temperature resistant elastomer.

22. The roller of claims 18, 19, 20 or 21 wherein said first material is a silicone elastomer.

23. The roller of claim 18 wherein said composite layer includes a third layer of a third material which is an elastomer which prevents offset of toner thereto and a layer intermediate to and continuous with said second and third layers in which the proportion of the second material to the third material gradually varies from substantially only the second material to substantially only the third material.

24. The roller of claim 23 wherein said first and third materials are silicone elastomers.

25. The roller of claim 18 wherein the proportion of the first material to the second material in said intermediate layer gradually increases from substantially none of said second material to substantially all of said second material.

26. The method of fusing a heat-softenable toner image to a receiver which comprises pressure contacting a heat-softenable toner image carried by a receiver with a fusing member at a temperature effective to fuse said toner image to said receiver member, said fuser member having a composite layer including:

(1) a first layer of a first material which is a high-temperature resistant elastomer;

(2) a second layer of a second material which is a high-temperature resistant elastomer which is an elastomeric fluoropolymer having a crosslinked polymer comprising repeating units of tetrafluoroethylene and perfluoroalkyl perfluorovinylether; and (3) a layer intermediate to and continuous with said first and second layers in which the proportion of the first material to the second material gradually varies from substantially only said first material to substantially only said second material.

* * * * *